US006467203B2

(12) United States Patent
Pippins

(10) Patent No.: US 6,467,203 B2
(45) Date of Patent: Oct. 22, 2002

(54) REMOVABLE TOOTH ASSEMBLY RETENTION SYSTEM AND METHOD

(75) Inventor: Sherlock Pippins, Dallas, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/944,815

(22) Filed: Aug. 30, 2001

(65) Prior Publication Data

US 2002/0023375 A1 Feb. 28, 2002

Related U.S. Application Data

(63) Continuation-in-part of application No. 09/372,156, filed on Aug. 20, 1999, which is a continuation-in-part of application No. 09/286,060, filed on Apr. 5, 1999, now Pat. No. 6,119, 378.

(51) Int. Cl.[7] ..... E02F 9/28
(52) U.S. Cl. ..... 37/452; 37/458
(58) Field of Search ..... 37/452, 454, 455, 37/456, 457, 458; 403/154, 152, 161, 317, 318, 379.2; 172/753, 772, 772.5, 762

(56) References Cited

U.S. PATENT DOCUMENTS

| | | | | |
|---|---|---|---|---|
| 1,216,290 A | | 2/1917 | Dickson | |
| 1,419,047 A | | 6/1922 | Hanks et al. | |
| 1,845,677 A | * | 2/1932 | Van Cortright Mekeel | |
| 2,064,059 A | * | 12/1936 | Fellmeth | |
| 2,113,420 A | * | 4/1938 | Younie | |
| 2,618,873 A | | 11/1952 | Hostetter | 37/142 |
| 2,635,366 A | | 4/1953 | Hostetter | 37/142 |
| 2,689,419 A | * | 9/1954 | Daniels et al. | |
| 2,934,842 A | * | 5/1960 | Buskirk | |
| 3,498,677 A | | 3/1970 | Morrow | 299/86 |
| 3,787,132 A | | 1/1974 | Garnett | 403/290 |
| 3,839,805 A | | 10/1974 | Stepe | 37/142 |
| 3,896,569 A | * | 7/1975 | Thompson et al. | |
| 3,967,399 A | | 7/1976 | Heinold et al. | 37/142 A |
| 3,974,579 A | | 8/1976 | Black et al. | 37/141 |
| 3,982,339 A | | 9/1976 | Nilsson | 37/141 |

(List continued on next page.)

OTHER PUBLICATIONS

"Dragline Products—Hensley Style" (eleven pages).
"Keech Castings Australia PTY. Limited," Aug. 31, 1995 (one page).
"Maglok® System," *Quality Steel Foundries Ltd.*
"Mining Vertalok® Adapters for Shovel Dippers," ©1992 ESCO Corporation. (4 pages).
"Posilok® Tooth Systems" (one page).
"Torqlok ® System," *Quality Steel Foundries Ltd.* (one page).

*Primary Examiner*—Victor Batson
(74) *Attorney, Agent, or Firm*—Baker Botts L.L.P.

(57) ABSTRACT

A tooth assembly for an excavating machine includes an adapter having first and second surfaces and first and second sides. The first surface of the adapter is generally tapered and converges toward a first end of the adapter. A tooth point is coupled with the adapter at the first end of the adapter, and the tooth point has a contact edge opposite the first end of the adapter. The tooth point also includes first and second sides, the first side having a slot adapted to receive a non-rotation ridge of a retainer pin to prevent rotation of the retainer pin with respect to the tooth point. A second end of the adapter is adapted to be removably coupled with a tooth horn. The tooth assembly further includes a central portion extending generally from the first side of the adapter to the second side, the central portion defining a central bore. In accordance with a particular embodiment of the present invention, a retainer pin with a non-rotation ridge may be coupled with the central portion of the tooth assemble at least partially within the central bore.

8 Claims, 6 Drawing Sheets

U.S. PATENT DOCUMENTS 4,067,657 A * 1/1978 Kaarlela
4,247,147 A 1/1981 Rettkowski ..... 299/10
4,326,348 A 4/1982 Emrich ..... 37/142
4,335,532 A 6/1982 Hahn et al. ..... 37/142
4,404,760 A 9/1983 Ryerson ..... 37/142 A
4,481,728 A 11/1984 Hahn et al. ..... 37/142 A
4,587,751 A 5/1986 Sjogren et al. ..... 37/142
4,662,762 A 5/1987 Schwarz ..... 384/25
4,663,867 A 5/1987 Hahn et al. ..... 37/142
4,716,667 A 1/1988 Martin ..... 37/142
4,727,663 A 3/1988 Hahn ..... 37/142
4,823,487 A 4/1989 Robinson ..... 37/142 A
RE33,042 E 9/1989 Emrich ..... 37/142
4,895,459 A 1/1990 Werner ..... 384/43
4,941,758 A 7/1990 Osawa ..... 384/40
5,009,017 A 4/1991 Diekevers et al. ..... 37/142
5,074,062 A 12/1991 Hahn et al. ..... 37/142 A
5,081,774 A 1/1992 Kuwano ..... 137/142
5,088,214 A 2/1992 Jones ..... 37/141
5,111,600 A 5/1992 Lukavich et al. ..... 37/141
5,152,088 A 10/1992 Hahn ..... 37/142
5,172,501 A 12/1992 Pippins ..... 37/142
5,181,780 A 1/1993 Morita ..... 384/8
5,233,770 A 8/1993 Robinson ..... 37/456
5,297,873 A 3/1994 Komiya ..... 384/45
5,337,495 A 8/1994 Pippins ..... 37/453
5,361,520 A 11/1994 Robinson ..... 37/458
5,410,826 A 5/1995 Immel et al. ..... 37/457
5,423,138 A 6/1995 Livesay et al. ..... 37/456
5,435,084 A 7/1995 Immel ..... 37/398
5,452,529 A 9/1995 Neuenfeldt et al. ..... 37/455
5,469,648 A * 11/1995 Jones et al.
5,484,210 A 1/1996 Gallone ..... 384/49
5,491,915 A * 2/1996 Robinson
5,638,621 A 6/1997 Keech et al. ..... 37/446
5,709,043 A 1/1998 Jones et al. ..... 37/458
5,802,795 A 9/1998 Myers et al. ..... 52/426
5,926,982 A 7/1999 Keech et al. ..... 37/455
5,937,550 A * 8/1999 Emrich
5,947,209 A 9/1999 Halford et al. ..... 172/772.5
5,983,534 A 11/1999 Robinson et al. ..... 37/459
5,992,063 A * 11/1999 Mack
6,000,153 A 12/1999 Sollami ..... 37/453
6,018,896 A * 2/2000 Adamic
6,052,927 A 4/2000 Pippins ..... 37/454
6,092,958 A 7/2000 Gale ..... 403/378
6,108,950 A * 8/2000 Ruvang et al.
6,119,378 A 9/2000 Pippins ..... 37/454
6,151,812 A 11/2000 Bierwith ..... 37/455
6,247,255 B1 * 6/2001 Clendenning

* cited by examiner

FIG. 13
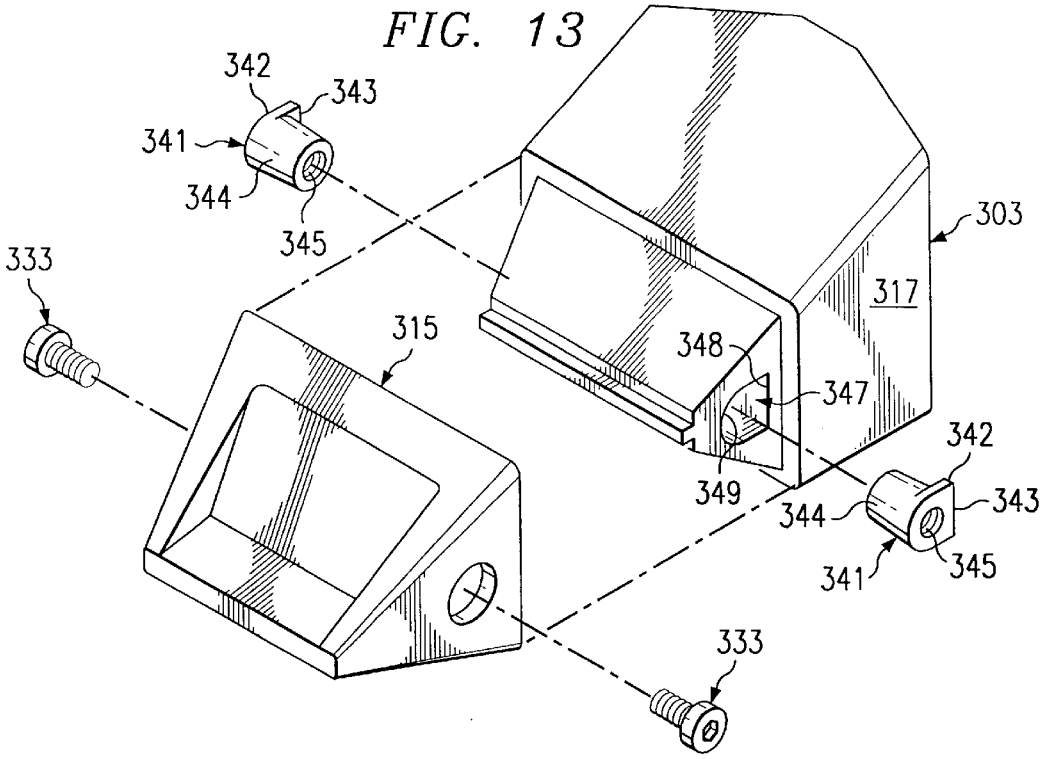
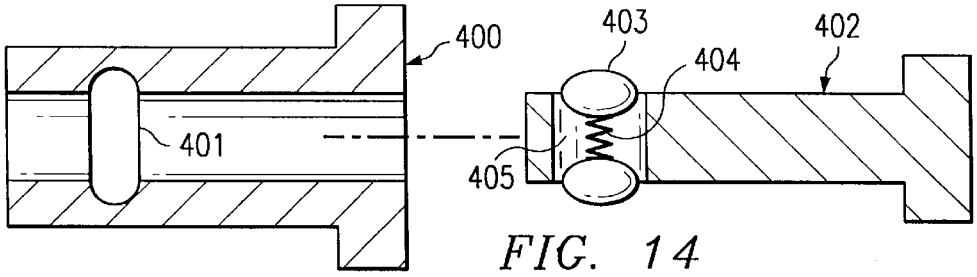
FIG. 14
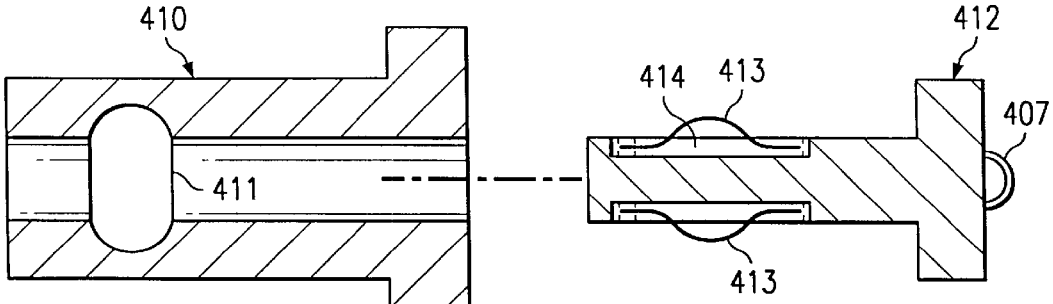
FIG. 15

REMOVABLE TOOTH ASSEMBLY RETENTION SYSTEM AND METHOD

RELATED APPLICATIONS

This application is a continuation-in-part of U.S. patent application Ser. No. 09/372,156 filed Aug. 20, 1999, which is a continuation-in-part of patent application Ser. No. 09/286,060 filed Apr. 5, 1999, now U.S. Pat. No. 6,119,378 dated Sep. 19, 2000.

TECHNICAL FIELD OF THE INVENTION

This invention relates generally to replaceable machine parts that are exposed to high wear and repeated shock loading, and more particularly, to removable tooth assembly retention systems and methods permitting easier and quicker changeovers of high wear replaceable parts.

BACKGROUND OF THE INVENTION

Digging and leveling apparatus such as draglines, backhoes, front-end loaders and the like often use replaceable tooth assemblies which are mounted on tooth horns to provide sacrificial parts that are exposed to the repeated shock loading and high wear occasioned by the digging operation. In such systems, each tooth assembly typically includes a wedge-shaped adapter which mounts directly on the tooth horn of the bucket, shovel or alternative digging or scraping mechanism of the equipment. A wedge-shaped tooth point is frontally seated on and rigidly pinned to the adapter for engaging the material to be excavated.

Attachment of the tooth point may be accomplished by means of one or more inserts which are inserted into insert cavities in an adapter. The inserts are internally threaded to accommodate a bolt that secures the tooth to the adapter. Installation and removal of teeth secured using such a system requires substantial time and effort, since the tooth point bolts must be screwed in and unscrewed when the tooth is to be replaced.

SUMMARY OF THE INVENTION

The present invention provides a removable tooth assembly retention system and method that substantially eliminates or reduces the problems and disadvantages associated with previous systems and methods.

In accordance with a particular embodiment of the present invention, a tooth assembly including an adapter with first and second surfaces and first and second sides is provided. The first surface of the adapter is generally tapered and converges toward a first end of the adapter. A tooth point is coupled with the adapter at the first end of the adapter, and the tooth point has a contact edge opposite the first end of the adapter. A first side of the tooth point has a slot adapted to receive a non-rotation ridge of a retainer pin to prevent rotation of the retainer pin with respect to the tooth point. The adapter has a second end adapted to be removably coupled with a tooth horn and a central portion defining a central bore extending from the first side of the adapter to the second side.

In accordance with another embodiment, a method for assembling a tooth assembly includes providing a tooth assembly adapter having first and second tapered surfaces and first and second sides. The first and second tapered surfaces converge toward a first end of the adapter. A tooth point is slidably mounted over at least a portion of the first end of the adapter such that an opening through a first side of the tooth point aligns with a central bore through the first side of the adapter. A retainer pin is inserted through the opening at least partially through the central bore until a detent member of the retainer pin engages a corresponding internal slot adjacent to the central bore. The retainer pin has a non-rotation component adapted to engage a corresponding slot in a second side of the tooth point when inserted through the opening.

Technical advantages of particular embodiments of the present invention include a retainer pin including a non-rotation structure which prevents rotation of the retainer pin with respect to a tooth assembly, during operation. Accordingly, wear and breakage of components associated with such rotation is substantially reduced.

Another technical advantage of particular embodiments of the present invention includes a retainer pin having a shaped configuration corresponding to a shaped slot associated with the tooth assembly. The cooperation of the retainer pin and the slot prevent rotation of the retainer pin within the tooth assembly.

Still another technical advantage of particular embodiments of the present invention include a removable tooth assembly that may be disassembled in a simplified manner using hand tools. Accordingly, time, labor and resources necessary to remove and/or replace various components are reduced.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the particular embodiments of the invention and their advantages, reference is now made to the following descriptions, taken in conjunction with the accompanying drawings, in which:

FIG. 13 is an isometric view of a tooth assembly, in accordance with an alternative embodiment of the present invention;

FIG. 14 is a cross-sectional view of a retainer pin and insert suitable for use with the tooth assembly of FIG. 13;

FIG. 15 is a cross-sectional view of an alternative embodiment retainer pin and insert suitable for use with the tooth assembly of FIG. 13;

DETAILED DESCRIPTION OF THE INVENTION

Figures 1, 3:
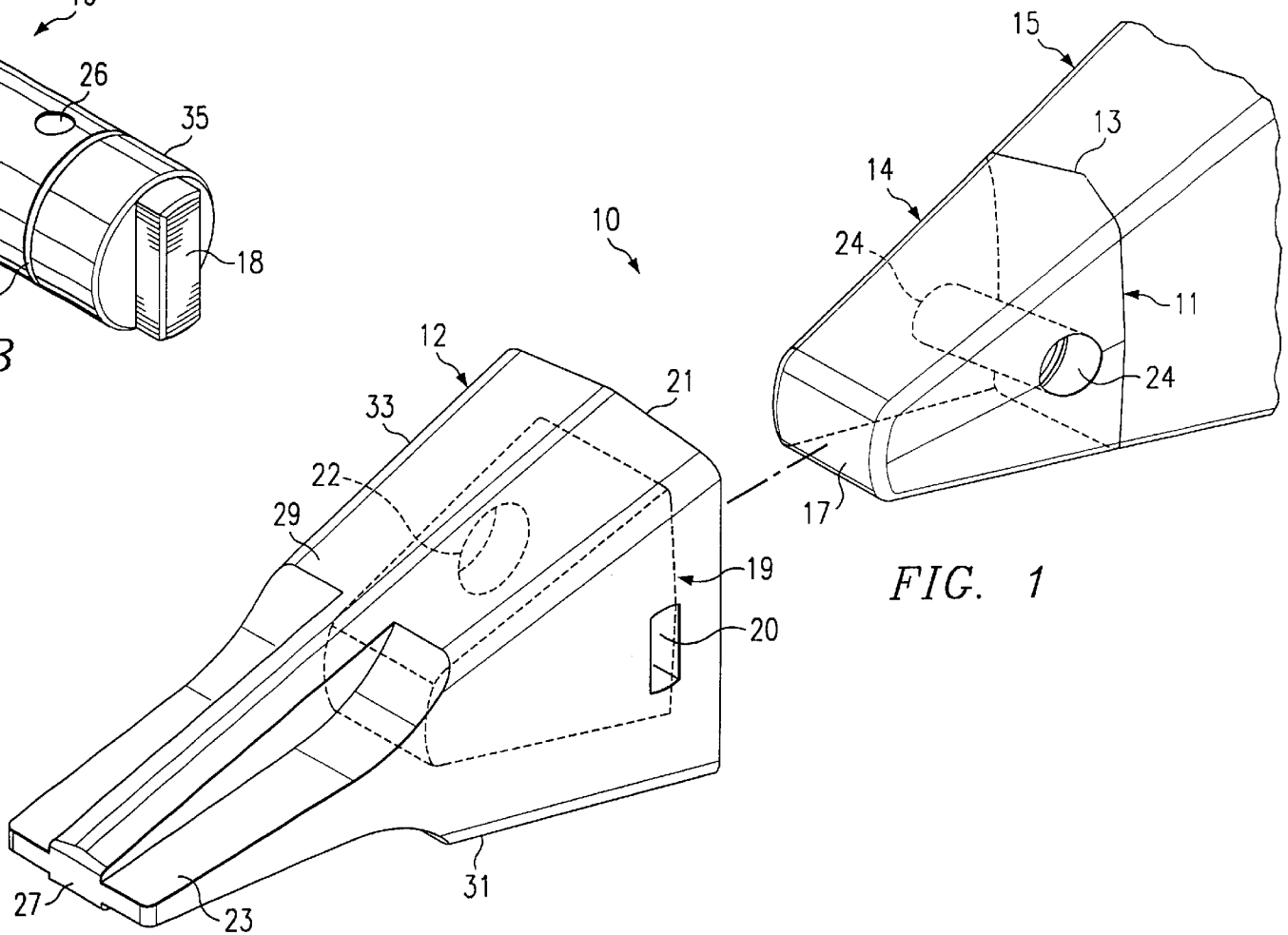
FIG. 1 is an isometric view illustrating a tooth assembly, in accordance with a particular embodiment of the invention.
FIG. 3 is an isometric view of the retainer pin of FIG. 2.
Figure 2:
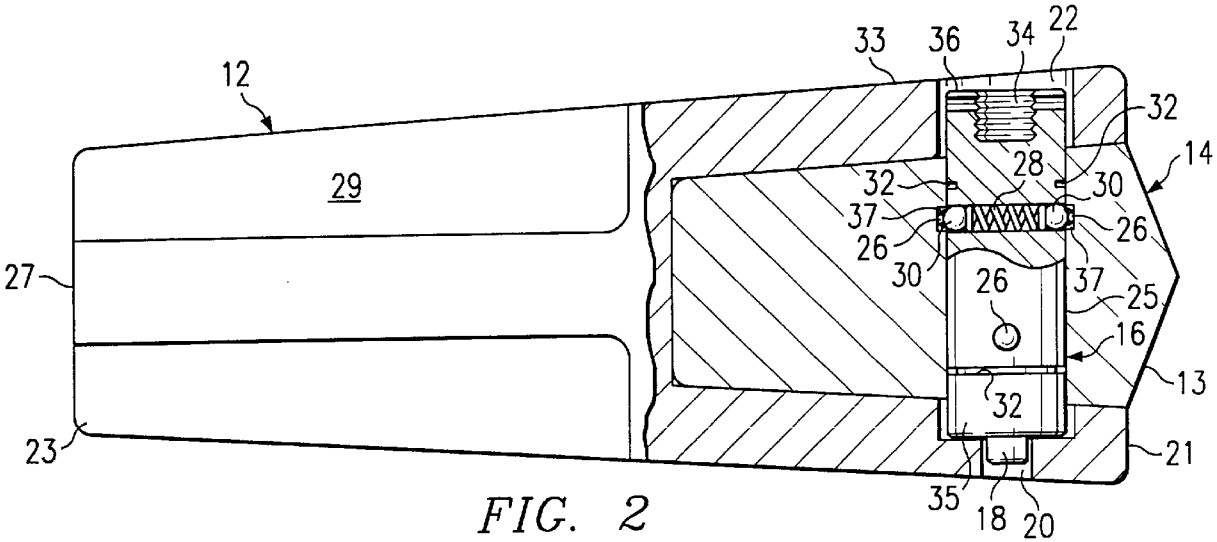
FIG. 2 is a cross-sectional view of a retaining pin and the tooth assembly of FIG. 1.

FIGS. 1 and 2 illustrate a tooth assembly 10 that may be mounted on a tooth horn 15 of a bucket, shovel or other part of an excavating machine. Tooth assembly 10 includes an adapter 14, and a tooth point 12 which may be removably coupled to adapter 14 using retainer pin 16. Tooth point 12 includes a slot 22 through which retainer pin 16 may be inserted. When tooth point 12 is mounted onto adapter 14 and retainer pin 16 is inserted through slot 22, retainer pin 16 passes through slots 24 of adapter 14. A non-rotation ridge 18 of retainer pin 16 (FIG. 3) engages non-rotation slot 20 of tooth point 12 to prevent rotation of retainer pin 16 with respect to tooth point 22 when retainer pin 16 is coupled with tooth point 12 and tooth assembly adapter 14. Accordingly, retainer pin 16 provides a secure coupling between tooth point 12 and adapter 14 that prevents rotation of retainer pin 16 while tooth assembly 10 is in use and simplified removal and/or replacement of tooth assembly 10 by users in the field.

Tooth assembly 10 is subject to significant wear and tear during excavation and/or mining operations. Extreme shock loading is experienced as tooth assembly 10 impacts adjacent earth, rocks, and other abrasive material. Therefore, it is desirable to make tooth assembly readily replaceable with a new or reconditioned tooth assembly of similar or identical configuration. Otherwise, buckets, shovels or other excavation equipment would need to be replaced more frequently, increasing equipment and labor costs associated therewith. By providing replaceable adapters 14 and tooth points 12 at locations upon the excavation equipment that experience high wear, the service life of such equipment is prolonged.

In order to prevent excessive wear at tooth horn 15, for example, adapter 14 is coupled with and at least partially conceals and/or protects tooth horn 15 from abrasive materials during excavation. Adapter 14 includes a recessed portion 11 at a first end 13. This allows tooth horn 15 to be received at least partially within the recessed portion when adapter 14 is coupled with tooth horn 15. A second end 17 of adapter 14 is tapered and configured to be received within a recessed portion 19 of tooth point 12. Slot 24 extends through adapter 14 near its first end 13.

Tooth point 12 includes a first end 21 adjacent recessed portion 19 and a second end 23 that forms a cutting or digging element 27 of tooth point 12. Upper face 29 and lower face 31 of tooth point 12 generally taper toward second end 23, and terminate at digging element 27. During excavation operations, tooth point 12 typically engages earth, rocks and other abrasive material at digging element 27. The tapered configuration of tooth point 12 allows digging element 27 and second end 23 to puncture the surface and break-up adjacent material. Tooth point 12 is then typically pushed or pulled through the surface in order to scrape away earthen material and debris. Accordingly, digging element 27, lower face 31, and upper face 29 bear the majority of the abrasive contact.

The configuration of tooth point 12 and adapter 14 accommodate the protection of mechanical components of tooth assembly 10. Specifically, the location of retainer pin 16 is remote from second end 23 of tooth point 12, which experiences significant impact from shock loading and abrasive contact. Similarly, slot 22 is located on a side 33 of tooth point 12, away from upper face 29 and lower face 31. This configuration avoids damage and wear to slots 20, 22 and 24 which could impair the removal of retainer pin 16 and/or separation of tooth point 12 from adapter 14.

FIGS. 2 and 3 illustrate retainer pin 16, which includes an elongate shaft 25 with non-rotation ridge 18 at a first end 35. Retainer pin 16 also includes detent members 26 to aid in securing retainer pin 16 with adapter 14 and tooth point 12. In the illustrated embodiment, detent members 26 include a spring 28 coupled with bearings 30; however, other suitable biasing components may be used as detent members 26 in order to aid in securing retainer pin 16 with a component in lieu of spring 28. Spring 28 urges bearings 30 radially outward such that bearings 30 engage corresponding slots 37 in adapter 14 to secure retainer pin 16 in tooth assembly 10. Retainer pin 16 includes grooves 32 to receive circular gaskets to keep debris away from detent members 26. Accordingly, grooves 32 are located adjacent first end 35 and second end 36 of retainer pin 16. Therefore, detent members 26 are located between grooves 32, to protect detent members 26 from ambient environment and debris.

Second end 36 of retainer pin 16, opposite non-rotation ridge 18, forms a threaded recess 34 to aid in extraction of retainer pin 16 from tooth assembly 10; however, other suitable structures may be used to aid in extraction of retainer pin 16. The extraction of retainer pin 16 will be discussed in greater detail with regard to FIGS. 4–6.

Figure 5:
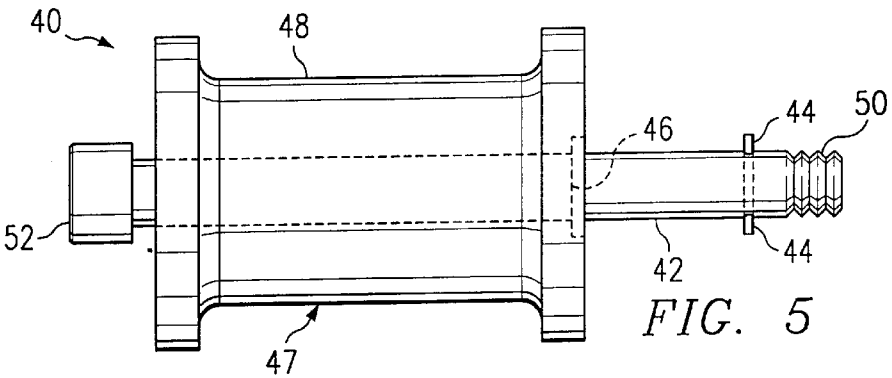
FIG. 5 is a side view of the extraction tool of FIG. 4.
Figure 4:
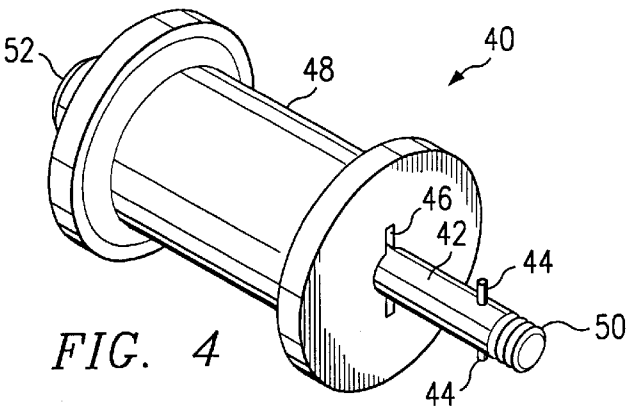
FIG. 4 is an isometric view of an extraction tool in accordance with a particular embodiment of the invention.
Figures 6, 7A, 7B, 8:
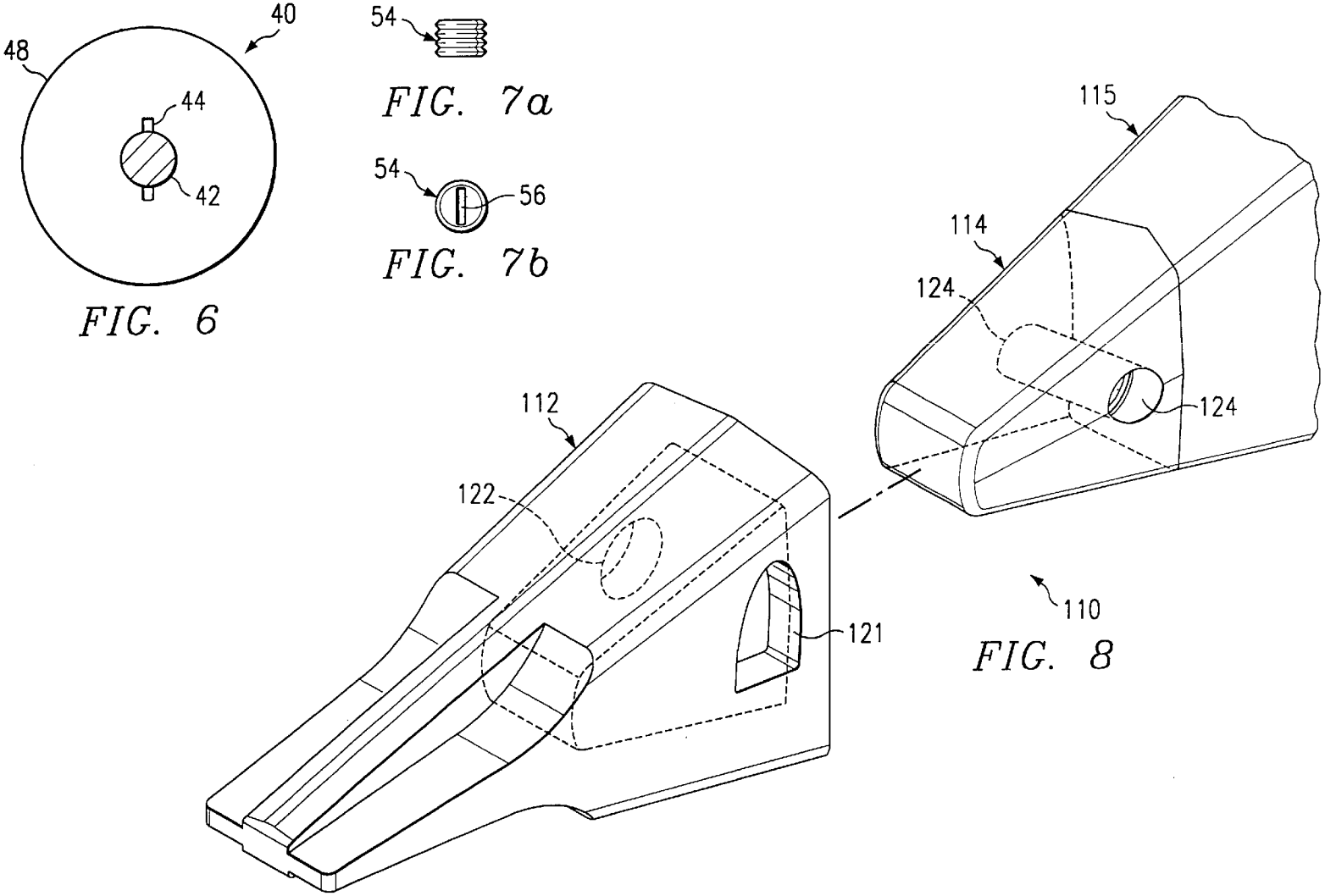
FIG. 6 is an end view of the extraction tool of FIG. 4.
FIGS. 7*a* and 7*b* illustrate a plug insert, in accordance with a particular embodiment of the invention.
FIG. 8 is an isometric view of a tooth assembly, in accordance with an alternative embodiment of the present invention.

FIGS. 4–6 illustrate an extraction tool 40 which may be used to install and/or disengage retainer pin 16 from tooth point 12 and adapter 14. Extraction tool 40 includes weighted member 48, which is operable to slide on an elongate body 42 of extraction tool 40. Extraction tool 40 has an enlarged end 52 and an opposite end 50 which may be threaded. Extraction tool 40 also includes locking members 44 which extend radially outward from elongate body 42. Weighted member 48 has a range of motion from enlarged end 52 to locking members 44. Weighted member 48 includes a locking recess 46, which is configured to receive locking members 44.

In accordance with a particular embodiment of the present invention, extraction tool 40 may be used to remove retainer pin 16 from tooth point 12 and adapter 14. In order to do so, threaded end 50 of extraction tool 40 is inserted at least partially into threaded recess 34, and elongate body 42 is rotated. This causes threaded end 50 to engage threaded recess 34 (FIG. 2) and couples extraction tool 40 with retainer pin 16.

Weighted member 48 may be used to tighten threaded end 50 within threaded recess 34. Weighted member 48 includes a gripping surface 48 suitable for an operator to grasp in order to maneuver weighted member 48 along elongate body 42. Weighted member 48 may be slid along elongate body 42 toward threaded end 50, until locking members 44 engage locking recess 46 of weighted member 48. Accordingly, rotation of weighted member 48 about a central axis of elongate body 42 translates to rotation of threaded end 50 with respect to threaded recess 34.

After a suitable coupling is formed between extraction tool 40 and retainer pin 16, weighted member 48 may be used to forcibly disengage retaining pin 16 from adapter 14 and tooth point 12. Weighted member 48 is then slid rapidly towards enlarged end 52. The operator grips surface 48 and forces weighted member 48 to collide with fixed, enlarged end 52. The force from this collision translates through elongate body 42 and pulls retainer pin 16 toward enlarged end 52. This sliding of weighted member 48 is repeated until retainer pin 16 disengages from tooth point 12 and adapter 14. The operator can apply additional force to weighted member 48, as necessary to disengage retainer pin 16 from adapter 14. After removing retainer pin 16 from adapter 14, retainer pin 16 may be rotated and disengaged from extraction tool 40.

FIGS. 7*a* and 7*b* illustrate a plug insert 54 which may be inserted into threaded recess 34 of retainer pin 16 when retainer pin 16 is coupled with tooth point 12 and adapter 14. Plug insert 54 may be used to keep debris out of recess 34 when tooth assembly 10 is in use. In the illustrated embodiment, plug insert 54 is threaded to facilitate insertion into and removal from recess 34. However, in alternative embodiments, plug insert 54 may be coupled with adapter 14 and/or tooth point 12 in a different manner, for example a friction fit. FIG. 7*b* is a cross-sectional view illustrating an end of plug insert 54 having indentation 56 which may receive a screwdriver or other tool to facilitate insertion and removal of plug insert 54.

Figure 9:
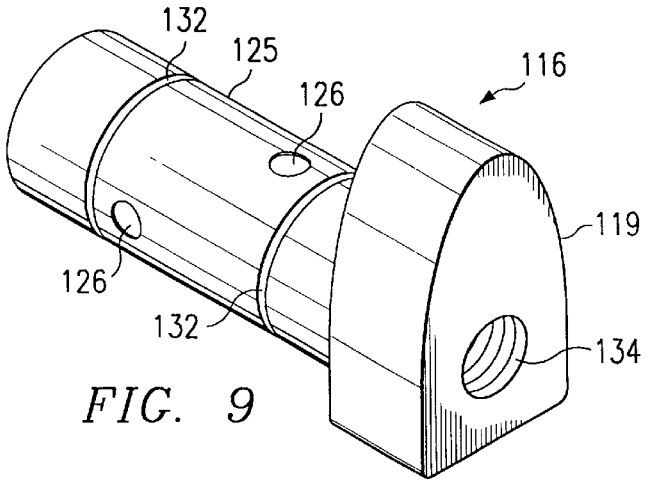
FIG. 9 is an isometric view of a retainer pin suitable for use with the tooth assembly of FIG. 8.
Figure 10:
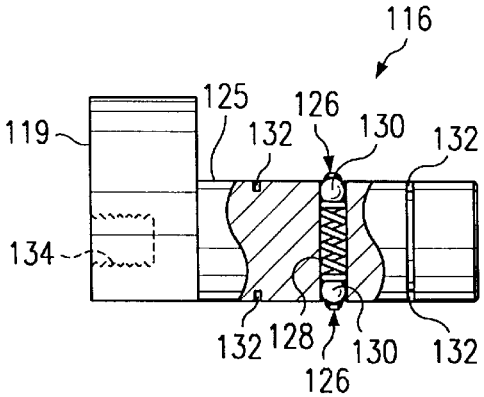
FIG. 10 is a side, cross-sectional view of the retainer pin of FIG. 9.

FIGS. 8–10 illustrate alternative embodiments of tooth assembly 10. FIG. 8 shows tooth assembly 110 which may be mounted on a tooth horn 115 of a bucket, shovel or other part of an excavating machine. Tooth assembly 110 includes a tooth point 112 which may be removably coupled to an adapter 114 using retainer pin 116 of FIGS. 9 and 10. Tooth point 112 has one side with a slot 121 configured to receive end 119 of retainer pin 116 (FIG. 9) and shaped to prevent rotation of retainer pin 116 with respect to tooth point 112 when retainer pin 116 is coupled with tooth point 112 and adapter 114.

In an alternative embodiment, retainer pin 116 may also include a non-rotation structure similar to non-rotation ridge 18. Accordingly, slot 122 may be configured to cooperate with the non-rotation structure to prevent rotation of retainer pin 116 during excavation operations. The configuration of end 119 of retainer pin 116 may vary from the configuration shown in FIGS. 9 and 10; thus, the configuration of slot 121 may also vary to correspond to the configuration of end 119. FIG. 8 also shows adapter 114 with slots 124, and tooth point 112 with slot 122, through which retainer pin 116 may pass when retainer pin 116 is coupled to tooth point 112 and adapter 114.

Retainer pin 116 may include threaded recess 134 so that retainer pin 116 may be removed from tooth point 112 and adapter 114 using extraction tool 40; this is accomplished in a similar manner as using extraction tool 40 to remove retainer pin 16 from tooth point 12 and adapter 14. However, other suitable methods may also be used to remove retainer pin 116 from tooth point 112 and tooth assembly adapter 14. As shown in FIGS. 9 and 10, retainer pin 116 has elongate shaft 125 and may also include features similar to those of retainer pin 16 discussed previously, such as gasket grooves 132 and detent members 126, which each include a spring 128 and bearings 130.

Figure 11:
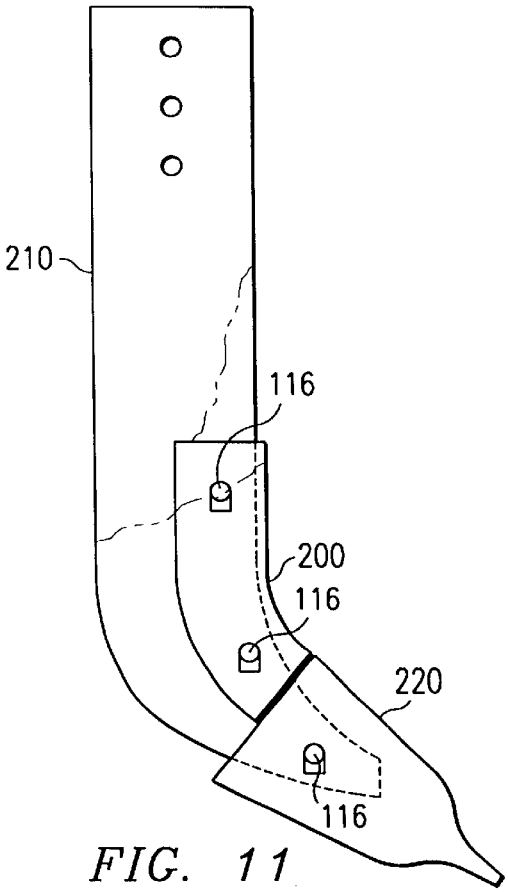
FIG. 11 is a side view of an excavating machine shank, shroud and tooth point, in accordance with a particular embodiment of the present invention.
Figure 12:
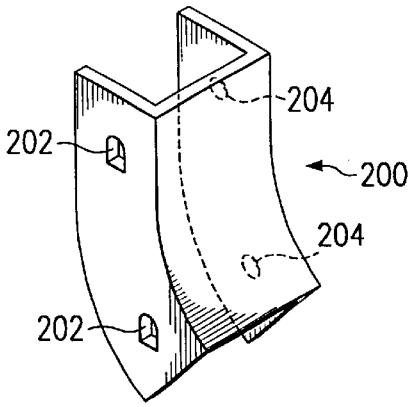
FIG. 12 is an isometric view of the shroud of FIG. 11.

FIGS. 11 and 12 illustrate a shroud 200 coupled with a shank 210 of an excavating machine part. Shroud 200 provides protection to shank 210 when the excavating machine is in use. The excavating machine may be a dragline used in mining operations or any other machine used for excavating purposes. Shroud 200 is coupled with shank 210 using retainer pin 116 of FIGS. 9 and 10. Shroud 200 includes non-rotation slots 202 shaped to receive end 119 of retainer pin 116 to prevent rotation of retainer pin 116 when shroud 200 is coupled to shank 210. Retainer pin 116 may be inserted through non-rotation slots 202 and may extend through to slots 204 of shroud 200 when shroud 200 is coupled to the shank. It should be understood that the configuration of end 119 may vary from the configuration shown in FIGS. 9 and 10; thus, the configuration of non-rotation slots 202 may also vary to correspond to the configuration of end 119. The shape of non-rotation slots 202 may be selected such that a retainer pin 116 having an end 119 having a corresponding shape will be prevented from rotating with respect to shroud 200. End 119 may also form a recess 134 to aid in extraction of retainer pin 116 from shroud 200, but other suitable structures may be used to aid in extraction of retainer pin 116. Tooth point 220 may also be coupled to shank 210 via retainer pin 116 or any other suitable means.

Shroud 200 is used to protect shank 210 from the abrasive environment encountered during excavation. Accordingly, shroud 200 is placed at a location upon shank 210 where significant wear and tear is anticipated. By providing a removable shroud 200 and removable tooth point 220, wear and degradation of shank 210 is reduced, thereby increasing its overall service life.

FIG. 13 illustrates another embodiment of the present invention. In FIG. 13, tooth point 315 is removably attached to adapter 303 by means of two tapered inserts 341, each inserted in a correspondingly-shaped insert cavity 347 provided in side walls 317 of adapter 303. Each insert 341 includes an insert bore 345 extending through a tapered, rounded insert body 344 which terminates in an insert shoulder 342. Insert shoulder 342 has a straight shoulder edge 343. The respective oppositely-disposed insert cavities 347 may be tapered and shaped to define a cavity shoulder 348 to engage insert shoulder 342 and a body curvature 349 to engage insert body 344. Accordingly, insert cavities 347 may receive inserts 341 and prevent the inserts 341 from rotating when pressure is applied to retainer pins 333, which secure the tooth point 315 on the adapter 303. Inserts 341 may also include a non-rotation ridge similar to non-rotation ridge 18. Those skilled in the art will understand that various shapes can be used for insert 341, such as square, circular, star-shaped and the like.

FIG. 14 illustrates an another embodiment of the invention showing a retainer pin 402 and a corresponding insert 400 which may be used to secure a tooth point to an adapter, for example, tooth point 315 and adapter 317. Retainer pin 402 has a cavity 405 containing at least one spring-loaded ball bearing 403 and a spring mechanism 404 which urges ball bearing 403 radially outward. Corresponding insert 400 includes an internal slot 401 suitable for accommodating the one or more ball bearings 403. When retainer pin 402 is inserted into the cavity of insert 400, ball bearings 403 retract until they reach internal slot 401, at which point spring mechanism 404 forces ball bearings 403 radially outward into slot 401. This secures retainer pin 402 in insert 400. Retainer pin 402 may include a recess similar to recess 34 and/or recess 134, for removal from insert 400 using extraction tool 40 of FIGS. 4 and 5; however, other suitable methods may also be used to remove retainer pin 402 from insert 400.

FIG. 15 illustrates an alternative embodiment in which a retainer pin 412 includes one or more springs 413 set into cavities 414. Springs 413 are used to retain retainer pin 412 in corresponding insert 410 by engaging slots 411. Retainer pin 412 may include a hook 407 which may be used to remove retainer pin 412 from insert 410; however, other suitable methods may also be used to remove retainer pin 412 from insert 410.

Figure 16:
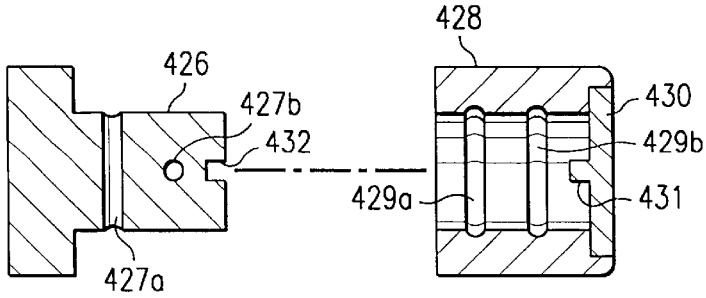
FIG. 16 is a cross-sectional view of a retainer pin and insert, in accordance with an alternative embodiment of the present invention.

FIG. 16 illustrates another embodiment of the invention in which retainer pin 426 is fitted with one or more cavities 427*a* and 427*b* containing at least one spring-loaded ball bearing or pin and a spring mechanism which urges the ball bearing or pin radially outward. Corresponding insert 428 includes one or more internal depressions 429 suitable for accommodating the one or more ball bearings or pins. When retainer pin 426 is inserted into the cavity of insert 428, the ball bearings or pins retract until they reach the internal depressions 429*a* and 429*b*, at which point the spring mechanism forces the ball bearings or pins radially outward into internal depressions 429*a* or 429*b* . In addition, retainer pin 426 includes a non-rotation device which may comprise a cap 430 with a transversely-extending ridge 431 that mates with a transversely-extending slot 432 in the base of retainer pin 426 when retainer pin 426 is fully seated in insert 428. It will be recognized that other arrangements of non-rotation devices are possible, so long as the goal of preventing rotation of the retainer pin relative to the insert is accomplished.

Figure 17A:
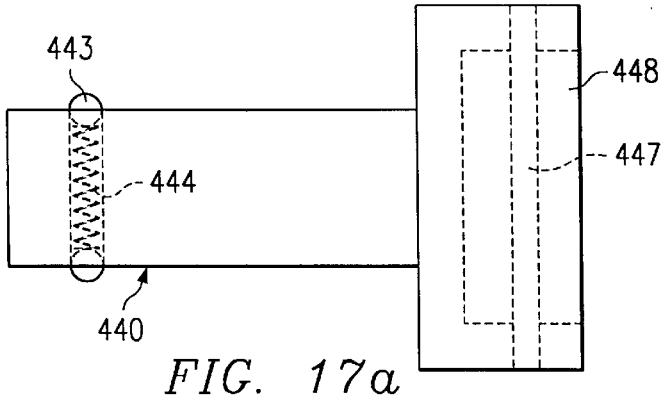
FIGS. 17*a* and 17*b* illustrate an alternative embodiment retainer pin suitable for use with the tooth assembly of FIG. 13.
Figure 17B:
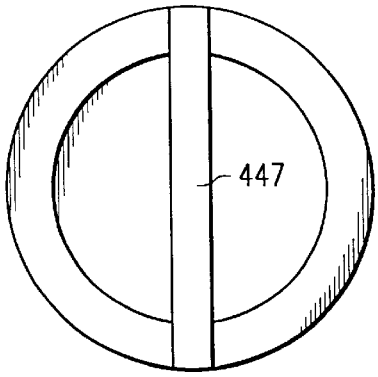

FIGS. 17*a* and 17*b* illustrate a retainer pin 440 with an alternative structure which may be used to remove retainer pin 440 from an insert or a tooth point and adapter. Retainer pin 440 includes a hook 447 formed as a bar recessed in a cavity 448 in the head of retainer pin 440. Retainer pin 440 also includes ball bearings 443 and spring 444 to engage corresponding internal depressions of an insert or adapter. It should be understood that the arrangements of springs or ball bearings and slots illustrated in FIGS. 14, 15, 16 and 17*a* can be reversed if desired, so that the springs or ball bearings are placed in the insert or adapter, and the mating slot is in the retainer pin.

Figure 18:
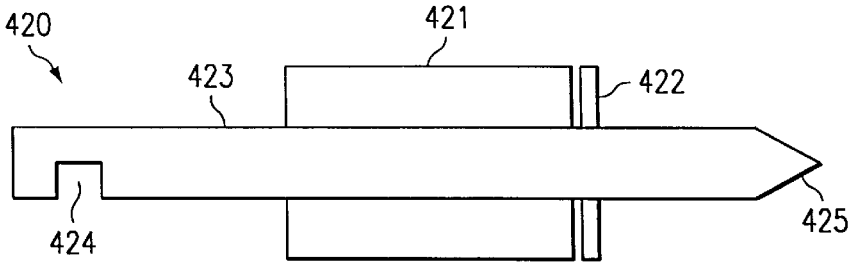
FIG. 18 is a cross-sectional view of an extraction tool, in accordance with an alternative embodiment of the present invention.

FIG. 18 illustrates an alternative embodiment of an extraction tool used to remove a retainer pin from an insert or a tooth point and adapter. Extraction tool 420 includes an elongate shaft 423 on which a sliding member 421 moves longitudinally. One end of elongate shaft 421 includes a recess 424 suitable for engaging a hook or recessed bar of a retainer pin. A stop 422 near the opposite end of elongate shaft 423 permits sliding member 421 to act as a slide hammer to dislodge the retainer pin. End 425 of extraction tool 420 may be pointed so that it can be used to clean out a cavity of a retainer pin, such as cavity 448 of FIG. 17*a*, before engaging a recessed bar with recess 424.

Particular aspects of the present invention have been described herein with regard to excavating machines and equipment such as draglines, backhoes, front-end loaders and the like. Those skilled in the art will understand, however, that particular aspects of the present invention are also applicable to other machines using replaceable parts. Examples of such machines include downhole drills and related tools, conveyor belt parts, center wear shrouds and wing shrouds on dragline buckets, and/or track shoes for tracked vehicles. Components of the particular embodiments of the invention described herein may be composed of a rigid material such as a metal alloy; a majority of the components in the illustrated embodiments comprise a steel alloy.

Although the present invention has been described in detail, various changes and modifications may be suggested to one skilled in the art. It is intended that the present invention encompass such changes and modifications as falling within the scope of the appended claims.

What is claimed is:

1. A tooth assembly, comprising:

an adapter having first and second surfaces, the first surface being generally tapered and converging toward a first end of the adapter;

a tooth point coupled with the adapter at the first end, the tooth point having a contact edge opposite the first end of the adapter;

a first side of the tooth point having a non-rotation slot adapted to receive a non-rotation ridge of a retainer pin to prevent rotation of the retainer pin with respect to the tooth point;

a second end of the adapter adapted to be removably coupled with a tooth horn;

a central portion extending generally from a first side of the adapter to a second side of the adapter, the central portion defining a central bore; and the central portion further defining an internal slot extending generally radially outwardly from the central bore, the internal slot configured to receive a detent member associated with the retainer pin.

2. A tooth assembly, comprising:

an adapter having first and second surfaces, the first surface being generally tapered and converging toward a first end of the adapter;

a tooth point coupled with the adapter at the first end, the tooth point having a contact edge opposite the first end of the adapter;

a first side of the tooth point having a non-rotation slot adapted to receive a non-rotation ridge of a retainer pin to prevent rotation of the retainer pin with respect to the tooth point;

a second end of the adapter adapted to be removably coupled with a tooth horn;

a central portion extending generally from a first side of the adapter to a second side of the adapter, the central portion defining a central bore;

a removable insert slidably coupled with the central portion at least partially within the central bore; and the retainer pin being coupled to the removable insert.

3. A tooth assembly, comprising:

an adapter having first and second surfaces, the first surface being generally tapered and converging toward a first end of the adapter;

a tooth point coupled with the adapter at the first end, the tooth point having a contact edge opposite the first end of the adapter;

a first side of the tooth point having a non-rotation slot adapted to receive a non-rotation ridge of a retainer pin to prevent rotation of the retainer pin with respect to the tooth point;

a second end of the adapter adapted to be removably coupled with a tooth horn;

a central portion extending generally from a first side of the adapter to a second side of the adapter, the central portion defining a central bore;

a removable insert slidably coupled with the central portion at least partially within the central bore;

the retainer pin being coupled to the removable insert; and the removable insert includes an internal slot extending at least partially therethrough, the internal slot being configured to receive a detent member associated with the retainer pin.

4. A tooth assembly, comprising:

an adapter having first and second surfaces, the first surface being generally tapered and converging toward a first end of the adapter;

a tooth point coupled with the adapter at the first end, the tooth point having a contact edge opposite the first end of the adapter;

a first side of the tooth point having a non-rotation slot adapted to receive a non-rotation ridge of a retainer pin to prevent rotation of the retainer pin with respect to the tooth point;

a second end of the adapter adapted to be removably coupled with a tooth horn;

a central portion extending generally from a first side of the adapter to a second side of the adapter, the central portion defining a central bore;

a removable insert slidably coupled with the central portion at least partially within the central bore;

the retainer pin being coupled to the removable insert; and the removable insert includes an internal slot configured to receive the non-rotation ridge of the retainer pin, to prevent rotation of the retainer pin with respect to the removable insert.

5. A tooth assembly, comprising:

an adapter having first and second surfaces, the first surface being generally tapered and converging toward a first end of the adapter;

a tooth point coupled with the adapter at the first end, the tooth point having a contact edge opposite the first end of the adapter;

a first side of the tooth point having a slot configured to receive a correspondingly-shaped end of a retainer pin to prevent rotation of the retainer pin with respect to the tooth point;

a second end of the adapter adapted to be removably coupled with a tooth horn;

a central portion extending generally from a first side of the adapter to a second side of the adapter, the central portion defining a central bore; and the central portion further defining an internal slot extending generally radially outwardly from the central bore, the internal slot configured to receive a detent member associated with the retainer pin.

6. A tooth assembly, comprising:

an adapter having first and second surfaces, the first surface being generally tapered and converging toward a first end of the adapter;

a tooth point coupled with the adapter at the first end, the tooth point having a contact edge opposite the first end of the adapter;

a first side of the tooth point having a slot configured to receive a correspondingly-shaped end of a retainer pin to prevent rotation of the retainer pin with respect to the tooth point;

a second end of the adapter adapted to be removably coupled with a tooth horn;

a central portion extending generally from a first side of the adapter to a second side of the adapter, the central portion defining a central bore;

a removable insert slidably coupled with the central portion at least partially within the central bore; and the retainer pin slidably coupled to the removable insert.

7. A tooth assembly, comprising:

an adapter having first and second surfaces, the first surface being generally tapered and converging toward a first end of the adapter;

a tooth point coupled with the adapter at the first end, the tooth point having a contact edge opposite the first end of the adapter;

a first side of the tooth point having a slot configured to receive a correspondingly-shaped end of a retainer pin to prevent rotation of the retainer pin with respect to the tooth point;

a second end of the adapter adapted to be removably coupled with a tooth horn;

a central portion extending generally from a first side of the adapter to a second side of the adapter, the central portion defining a central bore;

a removable insert slidably coupled with the central portion at least partially within the central bore;

the retainer pin slidably coupled to the removable insert; and the removable insert comprising a central portion, the central portion defining an internal slot configured to receive a detent member associated with the retainer pin.

8. A tooth assembly, comprising:

an adapter having first and second surfaces, the first surface being generally tapered and converging toward a first end of the adapter;

a tooth point coupled with the adapter at the first end, the tooth point having a contact edge opposite the first end of the adapter;

a first side of the tooth point having a slot configured to receive a correspondingly-shaped end of a retainer pin to prevent rotation of the retainer pin with respect to the tooth point;

a second end of the adapter adapted to be removably coupled with a tooth horn;

a central portion extending generally from a first side of the adapter to a second side of the adapter, the central portion defining a central bore;

a removable insert slidably coupled with the central portion at least partially within the central bore;

the retainer pin slidably coupled to the removable insert; and a first end of the removable insert includes a slot configured to receive a correspondingly-shaped end of the retainer pin to prevent rotation of the retainer pin with respect to the removable insert.

* * * * *